US008366079B2

(12) United States Patent
Stoffels et al.

(10) Patent No.: US 8,366,079 B2
(45) Date of Patent: Feb. 5, 2013

(54) SAFETY RAIL SYSTEM

(75) Inventors: Richard B. Stoffels, Eden Prairie, MN (US); James G. Sidla, Monticello, MN (US)

(73) Assignee: Garlock Equipment Company, Minneapolis, MN (US)

( * ) Notice: Subject to any disclaimer, the term of this patent is extended or adjusted under 35 U.S.C. 154(b) by 971 days.

(21) Appl. No.: 11/763,124

(22) Filed: Jun. 14, 2007

(65) Prior Publication Data

US 2008/0006809 A1 Jan. 10, 2008

Related U.S. Application Data

(60) Provisional application No. 60/804,724, filed on Jun. 14, 2006.

(51) Int. Cl.
*E04H 17/00* (2006.01)

(52) U.S. Cl. ..... 256/65.14; 256/DIG. 6

(58) Field of Classification Search ..... 256/24, 256/59, 65.14, 73, DIG. 6; 182/113, 141, 182/222; 248/231.41, 231.71, 251; 52/126.6, 52/182; 296/32, 36, 43, 186.1, 186.4, 186.5
See application file for complete search history.

(56) References Cited

U.S. PATENT DOCUMENTS

| | | | | |
|---|---|---|---|---|
| 2,517,386 | A | 8/1950 | Cooper | 256/25 |
| 2,895,717 | A | 7/1959 | Falco | 256/25 |
| 3,020,023 | A | 2/1962 | MacIntyre et al. | 256/24 |
| 3,188,696 | A * | 6/1965 | Earhart | |
| 3,396,851 | A * | 8/1968 | Collins et al. | 248/228.3 |
| 3,411,252 | A * | 11/1968 | Boyle, Jr. | |
| 3,469,822 | A | 9/1969 | O'Brien | 256/25 |
| 3,740,022 | A | 6/1973 | DiGiovanni | 256/24 |
| 3,776,521 | A | 12/1973 | Weinert | 256/24 |
| 3,863,900 | A * | 2/1975 | Dagiel et al. | 256/65.14 |
| 3,931,700 | A | 1/1976 | Scanni et al. | 52/590 |
| 3,946,992 | A * | 3/1976 | Elias | 248/231.71 |
| 3,995,833 | A * | 12/1976 | McLaughlin et al. | 256/65.14 |
| 4,015,826 | A | 4/1977 | Lauzier | 256/59 |
| 4,145,031 | A | 3/1979 | Baker, II | 256/65 |
| 4,645,183 | A | 2/1987 | Rattray et al. | 256/25 |
| 4,787,475 | A | 11/1988 | Arteau et al. | 182/82 |
| 4,787,603 | A | 11/1988 | Norton | 256/25 |
| 4,869,343 | A | 9/1989 | Anderson | 182/113 |
| 5,145,153 | A | 9/1992 | Glynn | 256/59 |

(Continued)

FOREIGN PATENT DOCUMENTS

| | | | |
|---|---|---|---|
| EP | 666389 | A1 * | 8/1995 |
| EP | 1081311 | A2 * | 3/2001 |

(Continued)

*Primary Examiner* — Victor MacArthur
(74) *Attorney, Agent, or Firm* — Alan Kamrath; Kamrath IP Lawfirm, P.A.

(57) ABSTRACT

A dual post receptor (30) of a safety rail system (10) has horizontal cross sections of an elongated shape with a width generally equal to and for slideable receipt of vertical posts (18) of conventional railings (12) and a length larger than double the diameters of the vertical posts (18). Elongated horizontal slots (38) are located in sides (34*a*, 34*b*) of the receptor (30) for receiving locking pins (22) also inserted through holes (20) in the vertical posts (18). Mounting the receptor (30) can be accomplished in a variety of manners including secured to a planar, horizontal mounting plate (46) secured to the bottom edges of the enclosure, secured to a vertical mounting plate (50) having a horizontal securement plate (56), secured to a protrusion (64) for slideable receipt in sockets such as in a truck bed, secured to a C-shaped clamp system of a variety of constructions, or the like.

9 Claims, 7 Drawing Sheets

U.S. PATENT DOCUMENTS

| | | | | | |
|---|---|---|---|---|---|
| 5,161,784 | A | | 11/1992 | Sader | 256/24 |
| 5,188,342 | A | | 2/1993 | Ouellette et al. | 256/65 |
| 5,362,030 | A | | 11/1994 | Iler, Jr. et al. | 256/65 |
| 5,413,298 | A | * | 5/1995 | Perreault | 248/228.6 |
| 5,456,451 | A | | 10/1995 | Eyler, Jr. | 256/67 |
| 5,518,337 | A | | 5/1996 | Modlin | 404/10 |
| 5,547,169 | A | | 8/1996 | Russell | 256/67 |
| 5,609,327 | A | | 3/1997 | Amidon | 256/24 |
| 5,683,074 | A | | 11/1997 | Purvis et al. | 256/67 |
| 5,713,171 | A | * | 2/1998 | Andres | 256/65.14 |
| 5,779,227 | A | | 7/1998 | Elkins et al. | 256/31 |
| 5,816,554 | A | | 10/1998 | McCracken | 248/346.01 |
| 5,842,685 | A | | 12/1998 | Purvis et al. | 256/67 |
| 6,029,954 | A | * | 2/2000 | Murdaca | 256/65.14 |
| 6,038,829 | A | | 3/2000 | Franks | 52/645 |
| 6,039,308 | A | | 3/2000 | Venegas, Jr. | 256/65 |
| 6,045,157 | A | * | 4/2000 | Poulin | 182/113 |
| 6,053,281 | A | | 4/2000 | Murray | 182/113 |
| 6,220,577 | B1 | | 4/2001 | Ostrow | 256/67 |
| 6,229,497 | B1 | | 5/2001 | McCracken | 343/878 |
| 6,283,457 | B1 | | 9/2001 | Venegas, Jr. | 256/65 |
| 6,554,257 | B1 | | 4/2003 | Kenton | 256/24 |
| 6,578,827 | B2 | | 6/2003 | McCracken | 256/59 |
| 6,585,080 | B2 | | 7/2003 | Murray | 182/45 |
| 6,644,901 | B2 | * | 11/2003 | Breckel | |
| 6,766,912 | B1 | * | 7/2004 | Gibbs | 248/231.41 |
| 6,845,970 | B1 | | 1/2005 | Kenton | 256/73 |
| 6,902,153 | B1 | | 6/2005 | Kenton | 256/65.1 |
| 7,284,746 | B2 | * | 10/2007 | Kuenzel | 256/65.14 |
| 2001/0007342 | A1 | | 7/2001 | McCracken | 248/68.1 |
| 2001/0020559 | A1 | | 9/2001 | McCracken | 182/222 |
| 2002/0081152 | A1 | | 6/2002 | King | 404/6 |
| 2002/0094235 | A1 | | 7/2002 | King | 404/6 |
| 2003/0042072 | A1 | | 3/2003 | Murray | 182/45 |
| 2003/0167724 | A1 | | 9/2003 | Mccracken | 52/690 |
| 2004/0103589 | A1 | | 6/2004 | Purvis et al. | 52/24 |

FOREIGN PATENT DOCUMENTS

| | | | | |
|---|---|---|---|---|
| FR | 2064630 | | * | 7/1971 |
| FR | 2229834 | A | * | 1/1975 |
| FR | 2589182 | A1 | * | 4/1987 |
| JP | 01121460 | A | * | 5/1989 |
| JP | 09060356 | A | * | 3/1997 |

* cited by examiner

SAFETY RAIL SYSTEM

BACKGROUND

The present invention relates to safety rail systems, and in preferred aspects to safety rail systems which are easier to use and in more applications than conventional safety rail systems.

Barricades are often required on a temporary (or removable) basis. Examples include but are not limited to at construction sites such as to keep workers from falling off an edge of a roof or a level, falling down uncompleted stairwells, and the like, to keep the general public out of construction sites, and the like. Other uses include limiting access such as at festivals, sporting events, and the like. Safety rail systems have become a favored manner of providing such barricades in many applications.

Such safety rail systems utilize railings formed of tubular stock and having horizontal rails extending between vertical posts. The advantages of such railings are that they can be mass produced in multiple sizes very economically. The railings of the desired size can then be selected according to the particular application. In the application, the lower ends of the posts of the railings are slid into tubular sockets of a corresponding shape. However, during normal use, storage, and transport of such railings, it is not uncommon for such railings to become bent. Although it is possible to attempt to rebend such bent railings, it is nearly impossible to rebend previously bent railings to their originally manufactured condition. Thus, it is difficult or time consuming attempting to utilize such rebent (and bent) railings. Additionally, although railings are available in multiple lengths, railings will not fit in all applications. Although this is not a major detriment where portable bases can be utilized, this is a major deficiency in permanent mounting applications and/or in applications including existing installations not compatible with conventional railings.

Thus, a need exists for a safety rail system which is easier to use with less hassles and/or in more applications which were not compatible or considered by conventional safety rail systems.

SUMMARY

The present invention solves this need and other problems in the field of safety rail systems by providing, in a first aspect, a novel receptor for simultaneously receiving vertical posts from first and second railings. Particularly, the post receptor defines an enclosure having cross sections of an elongated shape having a length and a width perpendicular to the length. The width of the elongated shape is generally equal to but slightly larger than the diameter of the vertical post for allowing slideable receipt of the vertical post without binding. The length of the elongated shape is generally larger than double the diameter of the vertical post.

In another aspect of the present invention, a novel mounting structure is provided for an assembly receiving the vertical posts from first and second railings and extending parallel to a vertical supporting surface. Particularly, the free edge of a flange extending from the post receiving assembly is secured to a mounting plate having a tongue bent therefrom and secured to the post receiving assembly spaced from the flange. In most preferred aspects, a securement plate extends generally perpendicularly from the mounting plate, with the mounting and securement plates abuttable with a corner with a support platform.

In still a further aspect of the present invention, a novel mounting structure is provided to allow use of first and second railings in an installation accepting a single stake. Particularly, a protrusion extends from a post receiving assembly and into a socket adapted to receive a stake such as in a truck bed, with the lower edges of the post receiving assembly abutting the support structure adjacent the socket.

In still another aspect of the present invention, a novel mounting structure is provided to allow use of first and second railings on a cantilevered ledge. In one preferred form, a tightening screw is threadably received in a horizontal leg of a L-shaped member having a vertical leg secured to the post receiving assembly. In most preferred aspects, a brace extends outwardly of the post receiving assembly opposite to the L-shaped member and for abutting with the support surface. In other preferred forms, a first horizontal leg of a L-shaped jaw is slideably mounted to an appendage of a T-shaped bracket, with a post receiving assembly secured to the horizontal leg of a L-shaped member having a vertical leg slideably mounted to the head of the T-shaped bracket.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
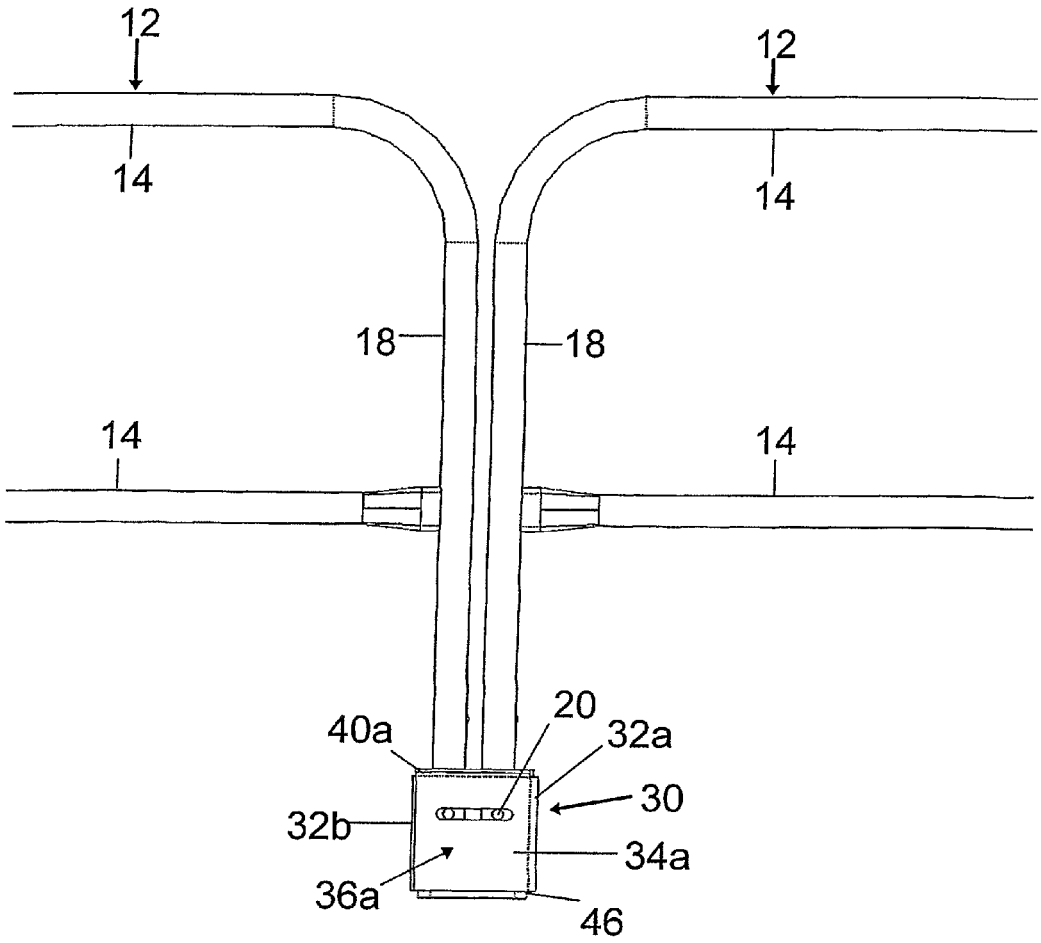
FIG. 1 shows a partial plan view of a safety rail system according to the preferred teachings of the present invention.
Figure 2:
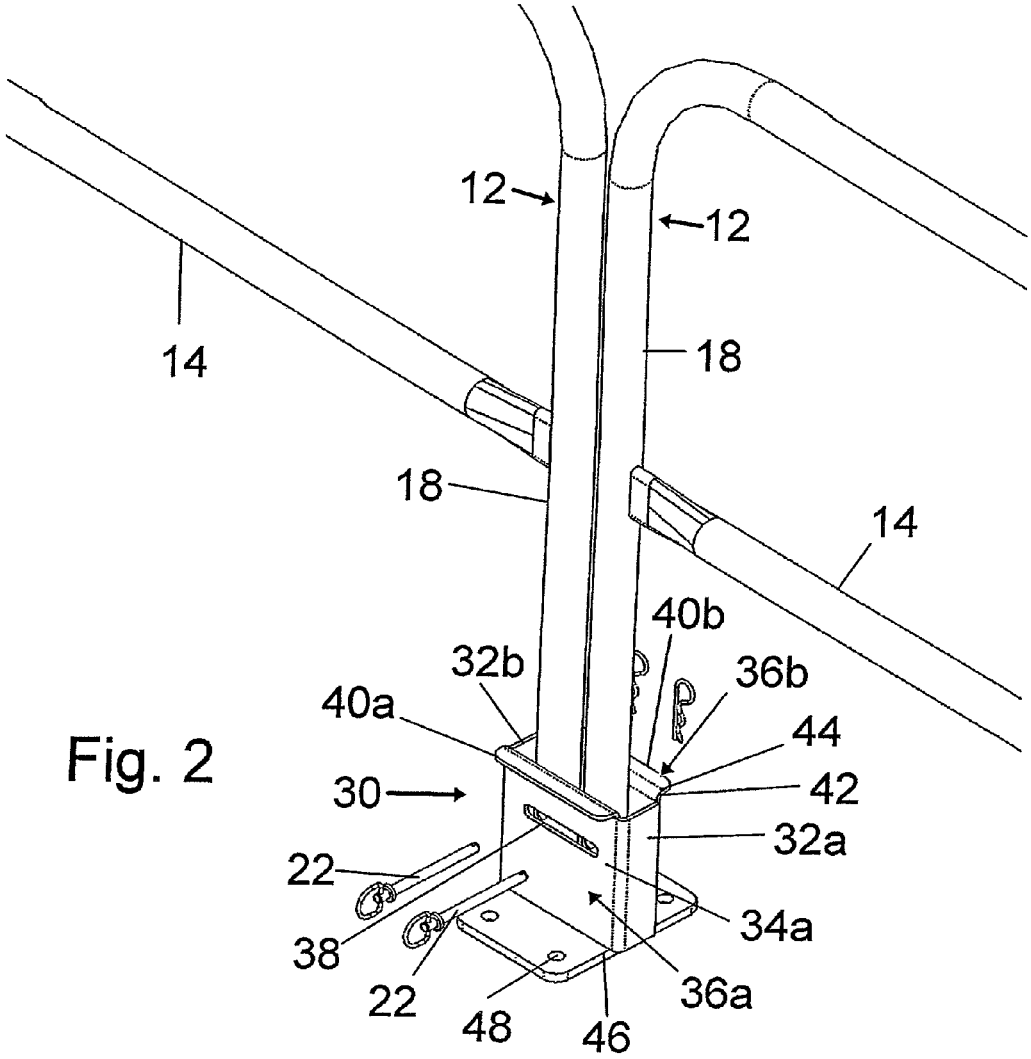
FIG. 2 shows a partial perspective view of the safety rail system of FIG. 1.
Figure 3:
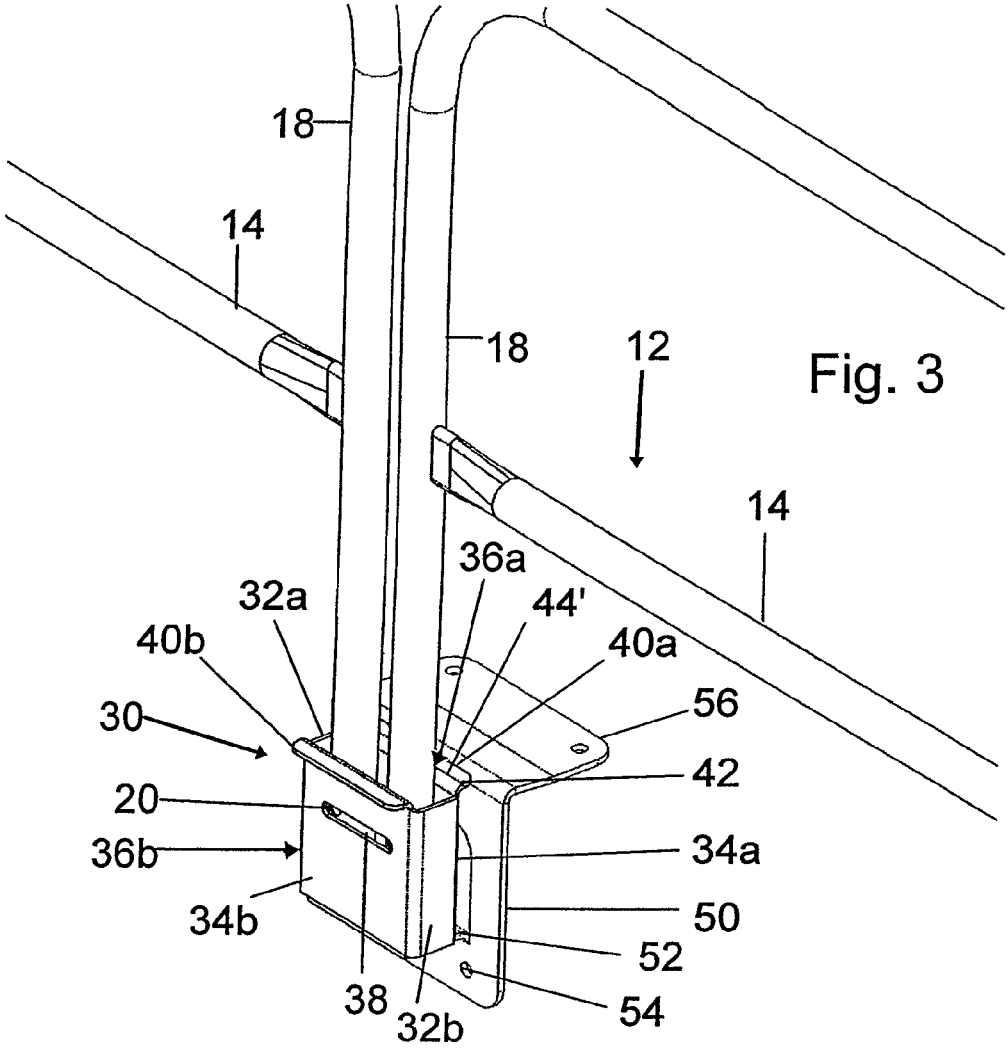
FIG. 3 shows a partial perspective view of an alternate embodiment of a safety rail system according to the preferred teachings of the present invention.
Figure 4:
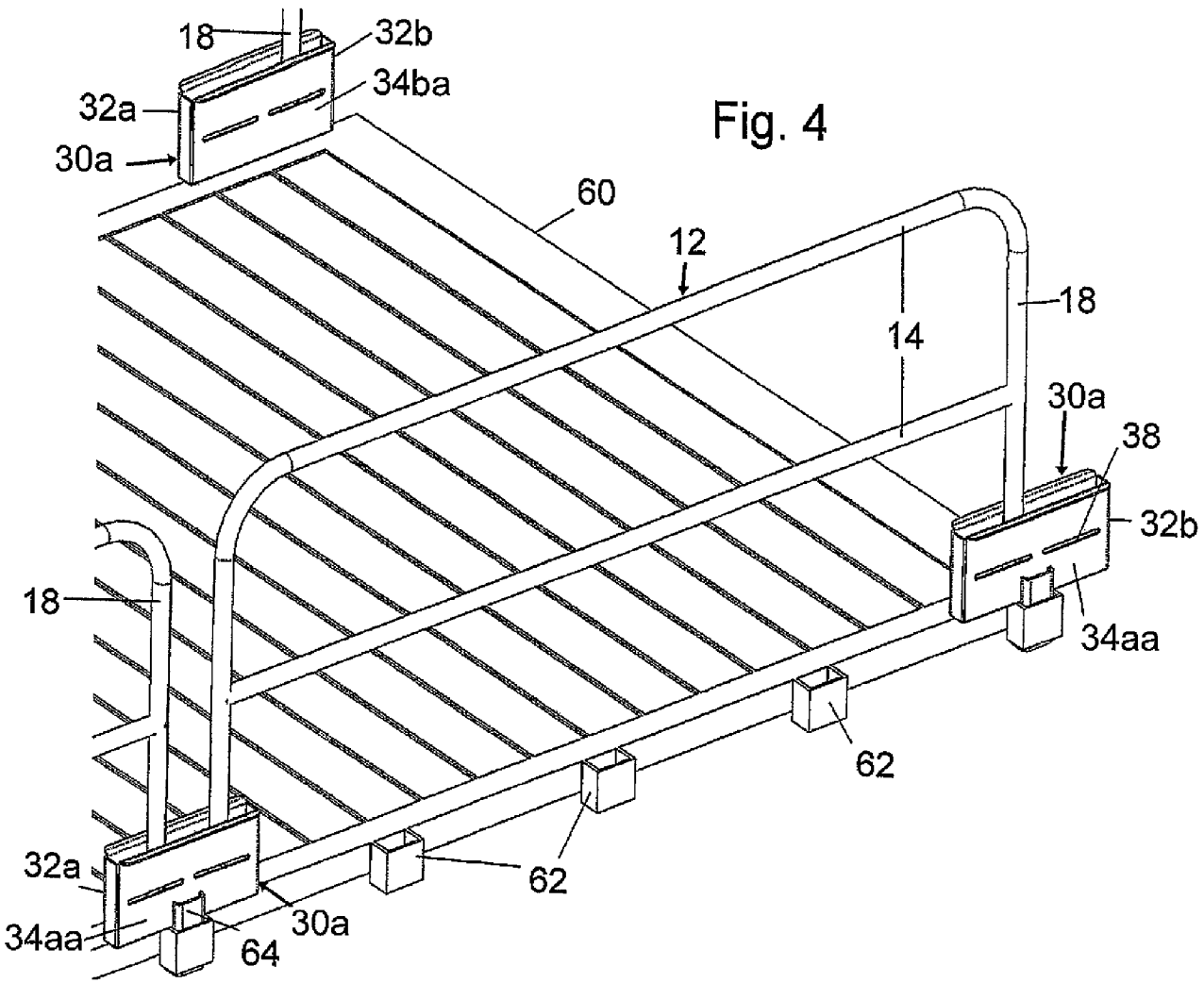
FIG. 4 shows a partial perspective view of an alternate embodiment of a safety rail system according to the preferred teachings of the present invention.
Figure 5:
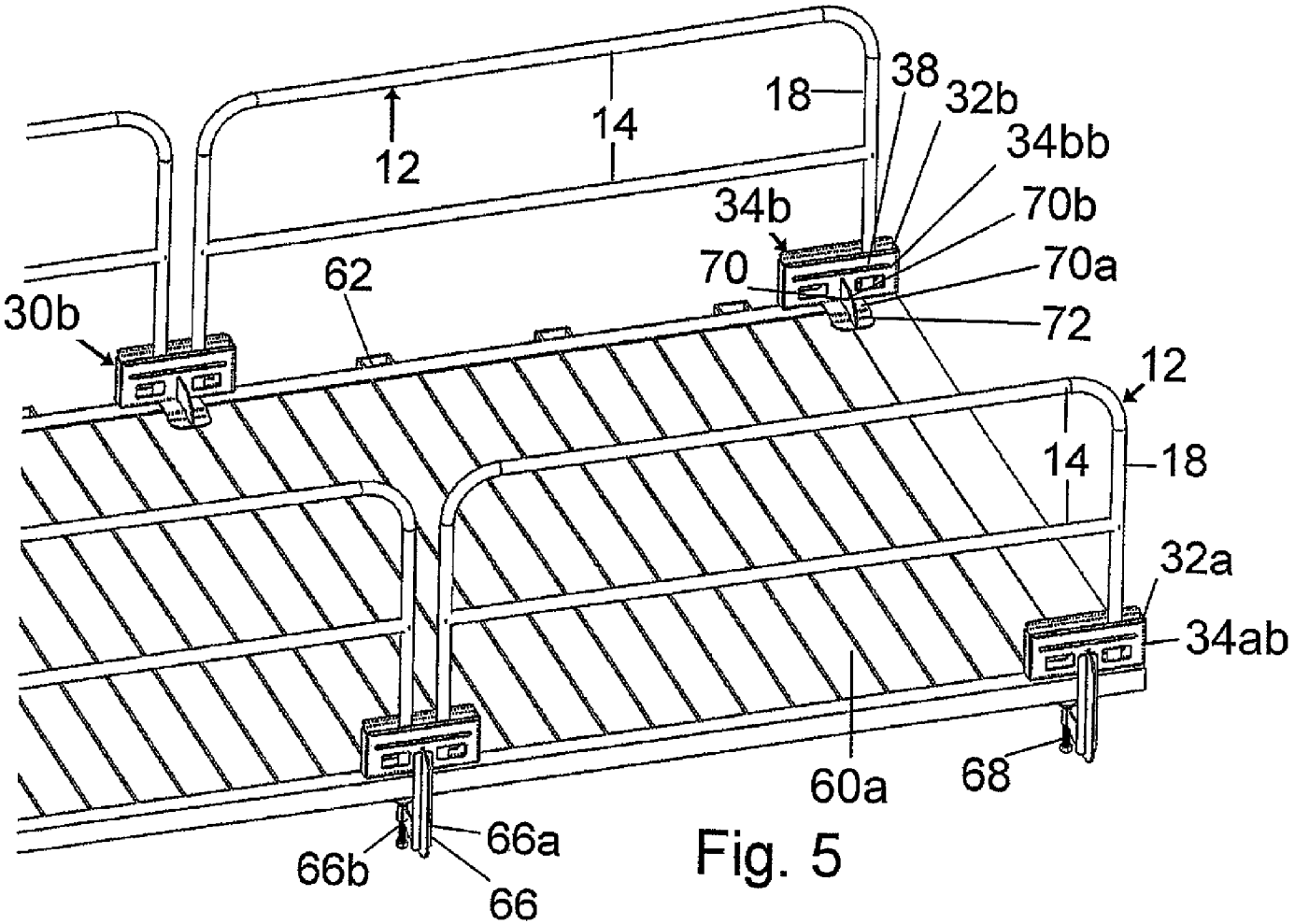
FIG. 5 shows a partial perspective view of an alternate embodiment of a safety rail system according to the preferred teachings of the present invention.
Figure 6:
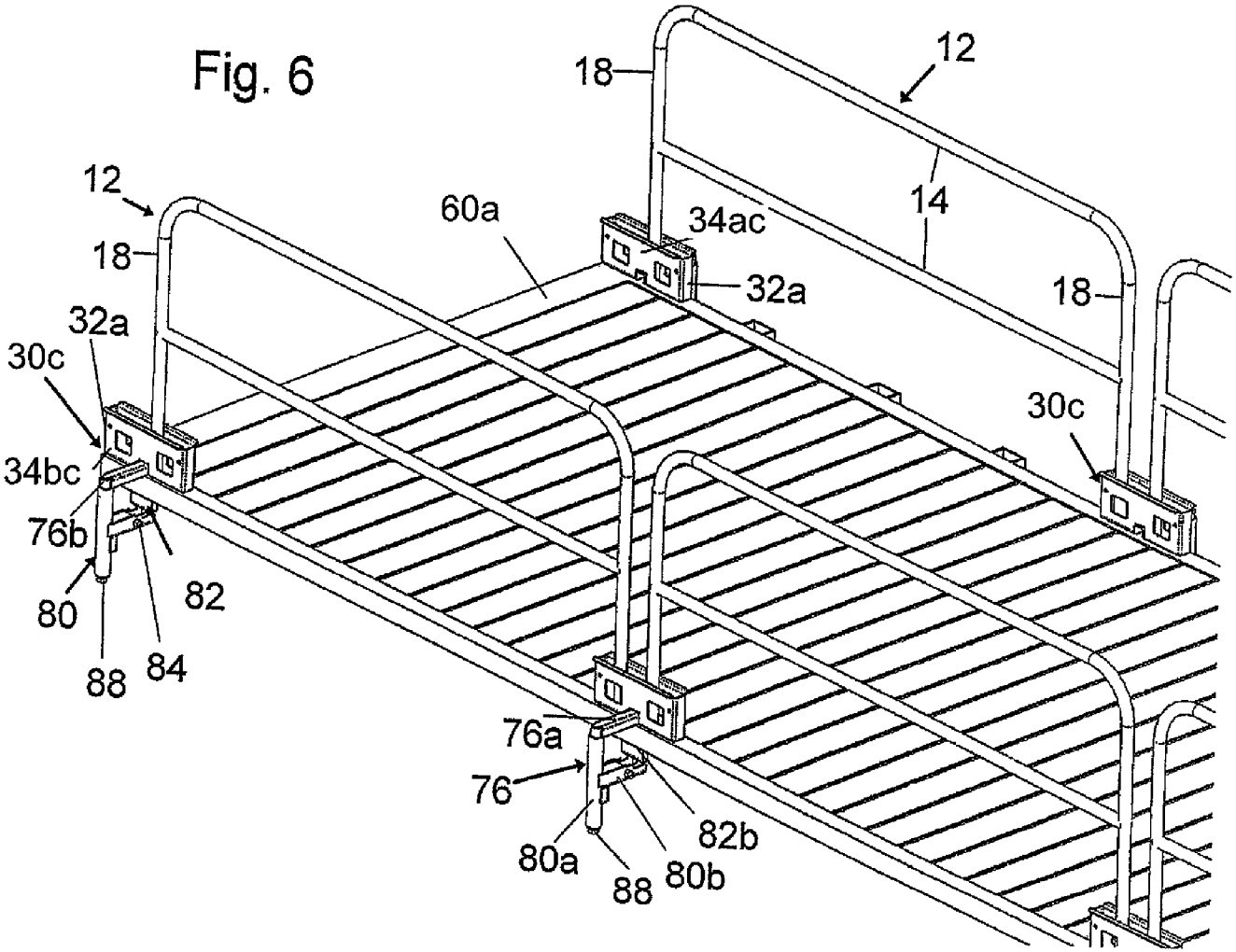
FIG. 6 shows a partial perspective view of an alternate embodiment of a safety rail system according to the preferred teachings of the present invention.
Figure 7:
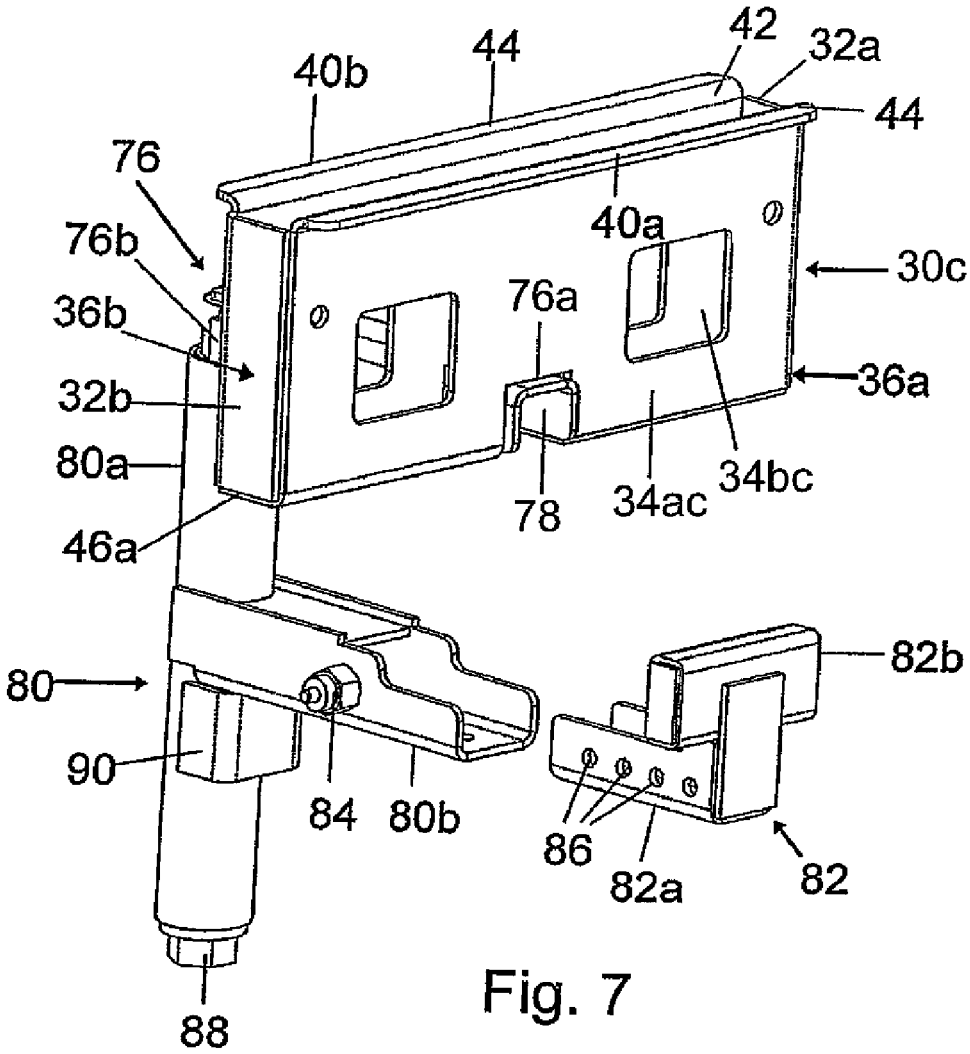
FIG. 7 shows a partial, exploded perspective view of the safety rail system of FIG. 6.

All figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "width", "length", "end", "side", "horizontal", vertical", "radial", and similar terms are used herein, it should be understood that these terms have reference only to the structure shown in the drawings as it would appear to a person viewing the drawings and are utilized only to facilitate describing the illustrative embodiment.

DESCRIPTION OF ILLUSTRATIVE EMBODIMENTS

A safety rail system according to the preferred teachings of the present invention is generally shown in the drawings. The safety rail system is utilized in connection with conventional railings 12 including at least first and second horizontal rails 14 extending between first and second vertical posts 18. Rails 14 and thus railings 12 can be manufactured in several different lengths which can be selected according to the particular application. Similarly, posts 18 and thus railings 12 can be manufactured in various heights. However, it is typical that railings 12 in any particular application will often be of the same height, but not necessarily so, and will often be of different lengths, but not necessarily so. The lower ends of each post 18 includes at least one attachment hole 20 extending radially therethrough for removable receipt of locking pins 22.

The safety rail system according to the preferred teachings of the present invention generally includes a dual post receptor 30. In particular and in the preferred form, receptor 30 includes first and second vertical ends 32*a* and 32*b* extending between first and second vertical sides 34*a* and 34*b* which define an enclosure having horizontal cross sections of an elongated annular shape and in the most preferred form of a rectangular shape. In the most preferred form, ends 32*a* and 32*b* and sides 34*a* and 34*b* are formed of planar material of a solid configuration. The spacing between sides 34*a* and 34*b* is generally equal to but slightly larger than the diameter of posts 18 allowing slideable receipt thereof without binding. The spacing between ends 32*a* and 32*b* is larger than double the diameter of posts 18 allowing simultaneously slideable receipt of posts 18 of first and second railings 12 without binding. In the most preferred form of the present invention, receptor 30 is formed by welding first and second components 36*a* and 36*b* together, with each having L-shaped cross sections. Specifically, component 36*a* includes end 32*a* and side 34*a* integrally formed of a single component by bending whereas component 36*b* includes end 32*b* and side 34*b* integrally formed of a single component by bending. End 32*a* is suitably secured to side 34*b* opposite to end 32*b* such as by welding. End 32*b* is suitably secured to side 34*a* opposite to end 32*a* such as by welding. However, it can be appreciated that receptor 30 can be formed in other manners including but not limited to being cast as a single component, being bent from a single component, or being formed from a multitude of components. Likewise, receptor 30 can have other shapes according to the teachings of the present invention such as, but not limited to, ends 32*a* and 34*b* being semi-cylindrical in shape.

According to the teachings of the present invention, receptor 30 includes elongated horizontal slots 38 located in sides 34*a* and 34*b* and extending substantially between ends 32*a* and 32*b*. In the most preferred form, slots 38 extend to within one half of the diameter of posts 18 and the distance between sides 34*a* and 34*b*. Slots 38 have a height generally equal to the diameter of attachment holes 20 of posts 18. Thus, locking pins 22 can be inserted through slots 38 and attachment holes 20 to prevent relative vertical movement of posts 18 and receptor 30.

In the most preferred form of the present invention, sides 34*a* and 34*b* include outwardly extending flanges 40*a* and 40*b*, respectively. Specifically, each of flanges 40*a* and 40*b* includes a convex portion 42 attached to the upper edge of the respective side 34*a* or 34*b* and extending outwardly therefrom. Further, each of flanges 40*a* and 42*b* includes a concave portion 44 attached to convex portion 42 opposite to the respective side 34*a* or 34*b* and extending outwardly therefrom. In the most preferred form, the radius of concave portion 44 is larger than the radius of convex portion 42.

Receptor 30 is suitably mounted to a supporting surface. In one preferred form, receptor 30 is desired to be permanently secured to a horizontal supporting surface. In a preferred form of the present invention, a planar mounting plate 46 is suitably secured to the bottom edges of ends 32*a* and 32*b* and sides 34*a* and 34*b* such as by welding. In the preferred form, plate 46 has a length generally equal to and slightly less than the spacing between ends 32*a* and 32*b* such that plate 46 is generally coextensive therewith. Further, plate 46 has a width considerably greater than the spacing between sides 34*a* and 34*b* and extends equidistance beyond sides 34*a* and 34*b*. Although shown as formed of a single piece of a constant thickness and having a generally square shape in the preferred form, mounting plate 46 can have a variety of shapes and forms according to the teachings of the present invention including, but not limited to, multi-piece constructions and/or of circular, rectangular or irregular shapes and thicknesses. Mounting plate 46 includes suitable provisions for securement to a horizontal supporting surface. Specifically, in the most preferred form, vertical bores 48 extend through mounting plate 46 spaced from receptor 30. In most preferred form, drainage apertures could be formed in the lower edge of side 34*a* and/or 34*b* adjacent to plate 46 to allow water to exit receptor 30 if mounted in an environment exposed to rain.

Permanent mounting would be desirable where it is not adverse to have receptors 30 remain in place at all times whereas it is not necessary or desirable for railings 12 to remain in place. An example of such an application could be roofs of flat building where railings 12 may not be desirable such as for aesthetic purposes and/or railings 12 may not be necessary and exposed to the elements under normal conditions but required for extraordinary conditions such as reroofing.

In other preferred forms, it is not desired that receptors 30 be permanently secured to a horizontal supporting surface but can be removably placed and/or relatively moved on the horizontal supporting surface. In such applications, receptors 30 could be suitably secured to mounting plates having relatively large masses such as cast or otherwise fabricated bases of the securement plate 56 can abut with a horizontal supporting surface and preferably be secured thereto such as by fasteners extending from the horizontal support surface.

In these applications, receptors 30 according to the teachings of the present invention do not extend above the horizontal supporting surface so as to provide an obstruction when railings 12 are removed from the safety rail system according to the teachings of the present invention.

According to the teachings of the present invention, the safety rail system can be utilized in applications which were not previously considered. As an example, one such application is in the case of a stake truck bed 60. Such beds 60 included spaced sockets 62 along its edges for receipt of stakes typically of rectangular cross sections. In a preferred aspect of the present invention, a protrusion 64 is secured to receptor 30*a* in any suitable manner such as by welding and for slideable receipt into a socket 62 of bed 60. In particular, protrusion 64 has cross sections generally equal to and for slideable receipt into sockets 62. In a preferred form shown, protrusion 64 is secured to side 34*aa* but extends vertically therebeyond and spaced from side 34*ba*. Thus, when protrusion 64 is received in socket 62, the lower edges of receptor 30*a* abut with the horizontal supporting surface of bed 60. In this respect, the bottom of the enclosure of receptor 30*a* could be left open such that the lower ends of posts 18 received in receptor 30*a* directly abut with bed 60 or could be closed such as by a plate suitably secured to the lower edges of ends 32*a* and 32*b* and/or sides 34*aa* and 34*ba*.

Similarly, in another preferred aspect of the present invention, an L-shaped member 66 has the upper end of a first leg 66*a* secured and extending downwardly parallel to side 34*ab* and having a second leg 66*b* extending under receptor 30*b* including sides 34*ab* and 34*bb*. A tightening screw 68 is threadably engaged adjacent the free end of leg 66*b*. In the most preferred form, an inverted T-shaped brace 70 is secured to the opposite side of receptor 30*b* than L-shaped member 66. Specifically, brace types shown in U.S. Pat. Nos. 3,020,023; 3,776,521; 4,787,603; 5,816,554; or 6,554,257. Thus, in such applications, it is generally desired to utilize the safety rail system for temporary purposes.

In another preferred form, it is desired that the safety rail system be utilized at a corner of a horizontal surface. In one type of application, receptor 30 according to the teachings of the present invention could be mounted to a modular stanchion holder such as of the type shown in U.S. Pat. No. 6,585,080. Alternately, receptor 30 according to the teachings of the present invention could be mounted to the vertical plate of a base of the type such as shown in U.S. Pat. No. 6,053,281. In a most preferred form, receptor 30 is mounted to a vertical mounting plate 50 extending generally parallel to but spaced from sides 34*a* and 34*b*. Specifically, a tongue 52 has its outer and side edges cut from plate 50 and its lower edge integrally formed with and bent generally perpendicular to plate 50. The width of tongue 52 between its side edges is generally equal to the spacing between ends 32*a* and 32*b*. The length of tongue 52 between its upper and lower edges is generally equal to the spacing between sides 34*a* and 34*b* plus the outward extent of flange 40*a*. Flange 40*a* is secured to plate 50 such as by welding. Likewise, the lower edges of ends 32*a* and 32*b* and/or sides 34*a* and 34*b* are secured to tongue 52 such as by welding. Rather than being concave, the outer portion 44' of flange 40*a* is linear and extends generally perpendicular to side 34*a*.

Suitable provisions are provided for mounting plate 50 to a vertical supporting surface. In a preferred form, bores 54 are provided through plate 50 for receipt of fasteners extending, from the vertical supporting surface. In a further, most preferred form, a securement plate 56 extends perpendicularly from the upper edge of plate 50 away from receptor 30. Thus, securement plate 56 can abut with a horizontal supporting surface and preferably be secured thereto such as by fasteners extending from the horizontal support surface.

In these applications, receptors 30 according to the teachings of the present invention do not extend above the horizontal supporting surface so as to provide an obstruction when railings 12 are removed from the safety rail system according to the teachings of the present invention.

According to the teachings of the present invention, the safety rail system can be utilized in applications which were not previously considered. As an example, one such application is in the case of a stake truck bed 60. Such beds 60 included spaced sockets 62 along its edges for receipt of stakes typically of rectangular cross sections. In a preferred aspect of the present invention, a protrusion 64 is secured to receptor 30*a* in any suitable manner such as by welding and for slideable receipt into a socket 62 of bed 60. In particular, protrusion 64 has cross sections generally equal to and for slideable receipt into sockets 62. In a preferred form shown, protrusion 64 is secured to side 34*aa* but extends vertically therebeyond and spaced from side 34*ab*. Thus, when protrusion 64 is received in socket 62, the lower edges of receptor 30*a* abut with the horizontal supporting surface of bed 60. In this respect, the bottom of the enclosure of receptor 30*a* could be left open such that the lower ends of posts 18 received in receptor 30*a* directly abut with bed 60 or could be closed such as by a plate suitably secured to the lower edges of ends 32*a* and 32*b* and/or sides 34*aa* and 34*ba*.

Similarly, in another preferred aspect of the present invention, an L-shaped member 66 has the upper end of a first leg 66*a* secured and extending downwardly parallel to side 34*ab* and having a second leg 66*b* extending under receptor 30*b*. A tightening screw 68 is threadably engaged adjacent the free end of leg 66*b*. In the most preferred form, an inverted T-shaped brace 70 is secured to the opposite side of receptor 30*b* than L-shaped member 66. Specifically, brace 70 includes a head plate 70*a* attached to the lower ends of ends 32*a* and 32*b* and sides 34*ab* and 34*bb* and extends perpendicular thereto. Brace 70 further includes a brace plate 70*b* secured to and extending perpendicular to side 34*bb* and to head plate 70*a*. In the most preferred form, head plate 70*a* can include detents 72 for creating a non-slip surface. Thus, bed 60*a* or a similar cantilevered supported ledge can be received between the head plate 70*a* abutting the top surface of bed 60*a* and screw 68 abutting the bottom surface of bed 60*a*. By tightening screw 68, receptor 30*b* is secured to bed 60*a* independent of sockets 62.

In another preferred form, an L-shaped member 76 has a free end of a first leg 76*a* received in a channel 78 formed in sides 34*ac* and 34*bc* and bottom 46*a* of receptor 30*c*, with leg 76*a* extending perpendicular to sides 34*ac* and 36*bc*. A second leg 76*b* of L-shaped member 76 is slideably received in the head 80*a* of a T-shaped bracket 80. A leg 80*b* of T-shaped bracket 80 extends in a spaced parallel relation to leg 76*a* and slideably receives the first leg 82*a* of an L-shaped jaw 82. L-shaped jaw 82 is removably fixed relative to T-shaped bracket 80 such as by a bolt 84 extending through one of a plurality of apertures 86 in first leg 82*a* and an aperture formed in leg 80*b*. The spacing between legs 76*a* and 80*b* can be adjusted such as by an adjustment rod 88 rotatably mounted (but axially fixed) in head 80*a* and threadably received in leg 76*b*. Thus, receptor 30*c* can be removably held relative to bed 60*a* clamped between leg 76*a* and the flee end of a second leg 82*b* of L-shaped jaw 82, with leg 76*a* and bottom 46*a* abutting with and extending parallel to the top surface of bed 60*a* whereas the second leg 82*b* extends generally perpendicular to the bottom surface of bed 60*a*. Jaw 82 can be positioned relative to bracket 80 such that any obstructions on the bottom surface of bed 60*a* adjacent its free edge can be positioned between leg 82*b* and head 80*a*.

In the preferred form shown, legs 76*a*, 80*b* and 82*a* each have U-shaped cross sections. Second leg 82*b* is tubular of rectangular cross sections and extending perpendicularly to the leg portions of the U-shaped cross sections of first leg 82*a*. Second leg 76*b* and head 80*a* are tubular of generally circular cross sections. Leg 80*b* further includes a brace 90 extending between the leg portions of the U-shaped cross sections from head 80*a* to bolt 84. The brace 90 is fixed to head 80*a* beneath leg 80*b*.

Now that the basic teachings of the present invention have been explained, many extensions and variations will be obvious to one having ordinary skill in the art. For example, although various manners of mounting the receptor have been shown and/or disclosed in preferred forms, other constructions for mounting and/or the supporting receptor can be utilized according to the teachings of the present invention.

Likewise, although the dual post receptor of the most preferred form is believed to be advantageous and produce synergistic results, the mounting structures as shown and/or disclosed could be utilized with other types of post receptors including but not limited to conventional post receptors and are believed to be advantageous in allowing installation of railings in various applications and installments.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

The invention claimed is:

1. Safety system comprising, in combination: at least a first railing including a vertical post, with the vertical post having a diameter; a post receptor defining an enclosure having cross sections of an elongated shape having a length and a width perpendicular to the length, with the enclosure having an open top parallel with the cross sections, with the width of the elongated shape being generally equal to but slightly larger than the diameter of the vertical post for allowing slideable receipt of the vertical post without binding, with the length of the elongated shape being generally larger than double the diameter of the vertical post; an L-shaped member having a first leg secured to the enclosure and extending outwardly parallel to the cross sections, with the L-shaped member further including a second leg extending generally perpendicularly from the first leg; a T-shaped bracket including a head, with the second leg being slideably mounted to the head; an adjustment rod rotatably mounted in the head and threadably received in the second leg, with the T-shaped bracket including an appendage extending perpendicular from the head and spaced from and parallel to the first leg; and an L-shaped jaw including a first leg slideably mounted to the appendage; a bolt extending through the appendage and the first leg of the L-shaped jaw, with the L-shaped jaw further including a second leg extending perpendicular to the first leg of the L-shaped jaw and arranged perpendicular to the appendage and the first leg of the L-shaped member.

2. The safety system of claim 1 with the enclosure including first and second sides extending parallel to the length.

3. The safety system of claim 2 with the enclosure including first and second ends extending parallel to the width and extending between the first and second sides.

4. The safety system of claim 3 with the first end and the first side being bent as a single component, with the second end and the second side being bent as a single component, with the first end secured to the second side and the second end secured to the first side.

5. The safety system of claim 1 with the enclosure including first and second sides extending parallel to the length, with the first and second sides including flanges extending outwardly from upper edges of each of the first and second sides.

6. The safety system of claim 5 further comprising, in combination: a mounting plate extending between and secured to lower edges of each of the first and second sides, with the mounting plate being mounted to the supporting surface to mount the post receptor to the supporting surface.

7. The safety system of claim 1 further comprising: a channel formed in the enclosure parallel to the width, with the first leg of the L-shaped member secured in the channel, with the enclosure including first and second sides extending parallel to the length and having lower edges, with the channel formed in the lower edges of the first and second sides.

8. Safety system comprising: a post receptor including a vertical enclosure for vertically slideably receiving a post of a railing; an L-shaped member having a first leg secured to the enclosure and extending horizontally outwardly of the enclosure, with the L-shaped member further including a second leg extending generally perpendicularly from the first leg; a T-shaped bracket including a head, with the second leg being slideably mounted to the head; an adjustment rod rotatably mounted in the head and threadably received in the second leg, with the T-shaped bracket including an appendage extending perpendicular from the head and spaced from and parallel to the first leg; and an L-shaped jaw including a first leg slideably adjustable relative to the appendage, with the L-shaped jaw further including a second leg extending perpendicular to the first leg of the L-shaped jaw and arranged perpendicular to the appendage and the first leg of the L-shaped member, with the first leg including a plurality of apertures, with the safety system further comprising: a bolt extending through the appendage and one of the plurality of apertures to adjust the spacing of the second leg of the L-shaped jaw from the head; and a horizontal channel formed in the vertical enclosure, with the first leg of the L-shaped member secured in the channel, with the vertical enclosure including lower edges, with the channel formed in the lower edges of the first and second sides.

9. Safety system comprising: a post receptor including a vertical enclosure for vertically slideably receiving a post of a railing; an L-shaped member having a first leg secured to the enclosure and extending horizontally outwardly of the enclosure, with the L-shaped member further including a second leg extending generally perpendicularly from the first leg; a T-shaped bracket including a head, with the second leg being slideably mounted to the head; an adjustment rod rotatably mounted in the head and threadably received in the second leg, with the T-shaped bracket including an appendage extending perpendicular from the head and spaced from and parallel to the first leg; an L-shaped jaw including a first leg slideably adjustable relative to the appendage; a bolt extending through the appendage and the first leg of the L-shaped jaw, with the L-shaped jaw further including a second leg extending perpendicular to the first leg of the L-shaped jaw and arranged perpendicular to the appendage and the first leg of the L-shaped member; and a horizontal channel formed in the vertical enclosure, with the first leg of the L-shaped member secured in the channel, with the vertical enclosure including lower edges, with the channel formed in the lower edges of the first and second sides.

* * * * *